US006586693B2

(12) United States Patent
Castonguay

(10) Patent No.: US 6,586,693 B2
(45) Date of Patent: Jul. 1, 2003

(54) SELF COMPENSATING LATCH ARRANGEMENT

(75) Inventor: Roger Neil Castonguay, Terryville, CT (US)

(73) Assignee: General Electric Company, Schenectady, NY (US)

( * ) Notice: Subject to any disclaimer, the term of this patent is extended or adjusted under 35 U.S.C. 154(b) by 195 days.

(21) Appl. No.: 09/727,028

(22) Filed: Nov. 30, 2000

(65) Prior Publication Data

US 2001/0030117 A1 Oct. 18, 2001

Related U.S. Application Data

(60) Provisional application No. 60/190,293, filed on Mar. 17, 2000.

(51) Int. Cl.[7] ..... H01H 1/52; H01H 3/20; H01H 9/00

(52) U.S. Cl. ..... 200/318; 200/345; 200/401; 335/166; 335/23; 335/170

(58) Field of Search ..... 200/324, 325, 200/401; 335/600, 9, 10, 22, 167, 168, 169, 171, 166, 170, 172, 173, 174, 175, 176, 23, 24, 25

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,621,189 A | * | 11/1971 | Link | 200/153 G |
| 3,631,369 A | | 12/1971 | Menocal | |
| 3,742,401 A | * | 6/1973 | Strobel | 335/9 |
| 3,783,215 A | * | 1/1974 | Brumfield | 200/153 G |
| 3,803,455 A | | 4/1974 | Willard | |
| 3,808,386 A | * | 4/1974 | Strobel | 200/153 G |
| 3,808,567 A | | 4/1974 | Maier | |
| 3,883,781 A | | 5/1975 | Cotton | |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |

(List continued on next page.)

FOREIGN PATENT DOCUMENTS

| | | |
|---|---|---|
| CH | 395 245 | 7/1965 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |

(List continued on next page.)

*Primary Examiner*—Elvin Enad
*Assistant Examiner*—Kyung Lee
(74) *Attorney, Agent, or Firm*—Cantor Colburn LLP

(57) ABSTRACT

A latching mechanism for a circuit breaker operating mechanism includes a primary latch with a cross bar and a first pair of elongated leg members flexibly mounted to the cross bar. A secondary latch is pivotally mountable to the circuit breaker operating mechanism, with the first pair of elongated leg members being in removable engagement with the secondary latch. In one embodiment, the cross bar is flexible and deflects at a point along a longitudinal axis thereof. In another embodiment, the cross bar is flexible and twists about its longitudinal axis.

13 Claims, 4 Drawing Sheets

U.S. PATENT DOCUMENTS 4,166,988 A 9/1979 Ciarcia et al.
4,220,934 A 9/1980 Wafer et al.
4,220,935 A * 9/1980 Wafer et al. ..... 335/38
4,255,732 A 3/1981 Wafer et al.
4,259,651 A 3/1981 Yamat
4,263,492 A 4/1981 Maier et al.
4,276,527 A 6/1981 Gerbert-Gaillard et al.
4,297,663 A 10/1981 Seymour et al.
4,301,342 A 11/1981 Castonguay et al.
4,360,852 A 11/1982 Gilmore
4,368,444 A 1/1983 Preuss et al.
4,375,021 A 2/1983 Pardini et al.
4,375,022 A 2/1983 Daussin et al.
4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 DiMarco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,622,530 A * 11/1986 Ciarcia et al. ..... 335/167
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dziura et al.
4,900,882 A 2/1990 Bernard et al.
4,910,485 A 3/1990 Bologeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclerq et al.
5,004,878 A 4/1991 Seymour et al.
5,029,301 A 7/1991 Nebon et al.
5,030,804 A 7/1991 Abri
5,057,655 A 10/1991 Kersusan et al.
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livsey et al.
5,262,744 A 11/1993 Arnold et al.
5,280,144 A 1/1994 Bolongeat-Mobleu et al.
5,281,776 A 1/1994 Morel et al.
5,296,660 A 3/1994 Morel et al.
5,296,664 A 3/1994 Crookston et al.
5,298,874 A 3/1994 Morel et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,424,701 A 6/1995 Castonguay et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth et al.

| | | | |
|---|---|---|---|
| 5,504,290 | A | 4/1996 | Baginski et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |
| 6,262,644 | B1 * | 7/2001 | Castonguay et al. ..... 335/167 |

FOREIGN PATENT DOCUMENTS

| | | |
|---|---|---|
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |
| WO | WO 99/62092 | 12/1999 |

* cited by examiner

SELF COMPENSATING LATCH ARRANGEMENT

CROSS-REFERENCE TO RELATED APPLICATIONS

This application claims the benefit of the Provisional Application Serial No. 60/190,293 filed Mar. 17, 2000, which is hereby incorporated by reference.

BACKGROUND OF THE INVENTION

The present invention relates to circuit breakers, and, more particularly, to a latching arrangement in a circuit breaker operably linked to an actuating device which initiates the process of opening electrical contacts within the circuit breaker.

Circuit breaker operating mechanisms are used to control the opening and closing of separable contacts within a circuit breaker system. These operating mechanisms utilize linkage arrangements to translate the potential energy of biased springs into an output force required to quickly trip the circuit and separate the contacts in the event that a fault condition occurs. In a typical circuit breaker operating mechanism, a solenoid or other actuating device is used to detect an overcurrent or fault condition. When energized, the solenoid trips a first latching mechanism which, in turn, trips a second latching mechanism associated with a cradle assembly pivotally mounted within the circuit breaker. The cradle assembly then engages a contact arm which causes the contacts to be opened.

Latching systems found in prior art require components that are extremely accurate with respect to one other to insure proper mechanical latching between primary and secondary latches. In addition, the accuracy of latching components is also important in preventing spurious and unwanted tripping of the circuit breaker. However, it is also costly to design and manufacture latching components which adhere to precise tolerances.

SUMMARY OF THE INVENTION

The above discussed and other drawbacks and deficiencies of the prior art are overcome or alleviated by a latching mechanism for a circuit breaker operating mechanism, the latching mechanism includes a primary latch with a cross bar and a first pair of elongated leg members flexibly mounted to the cross bar. A secondary latch is pivotally mountable to the circuit breaker operating mechanism, with the first pair of elongated leg members being in removable engagement with the secondary latch. In one embodiment, the cross bar is flexible and deflects at a point along a longitudinal axis thereof. In another embodiment, the cross bar is flexible and twists about its longitudinal axis.

DETAILED DESCRIPTION OF THE INVENTION

Figure 1:
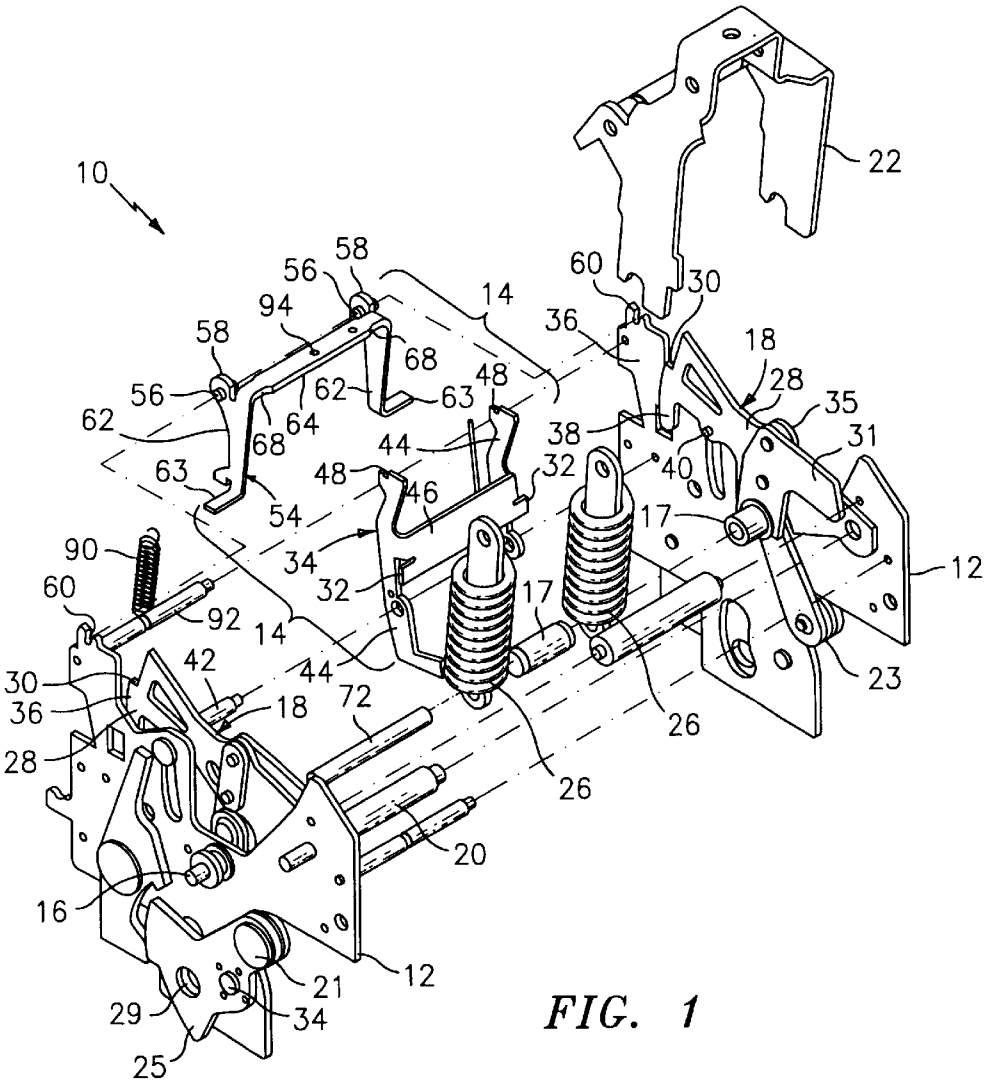
FIG. 1 is a perspective and exploded view of a circuit breaker operating mechanism illustrating the latching mechanism of the present invention.

Referring to FIG. 1, a circuit breaker operating mechanism embodying the present invention is shown generally at 10. Circuit breaker operating mechanism 10 includes a pair of sideplates 12 fixedly spaced so as to be in a substantially parallel configuration mounted to a rotary contact assembly (shown as 80 in FIG. 3), which is in turn mounted to a baseplate (shown as 82 in FIG. 3). A latching mechanism, shown generally at 14, is positioned between sideplates 12 and functions to latch and unlatch or trip operating mechanism 10. Also between sideplates 12 are mounted various parts necessary for the operation of mechanism 10. In particular, operating mechanism 10 further includes a handle yoke 22 pivotally mounted between sideplates 12 handle yoke pin and pins 16 (one of which is seen in FIG. 1). Handle yoke 22 protrudes from between sideplates 12 for mounting an operating handle (shown as 88 in FIG. 3) thereto. Operating mechanism 10 also includes a cradle assembly 18 supported by a cradle support pin 20 extending between sideplates 12. Cradle assembly 18 is operably linked to toggle links 31 by pins 35. Toggle links 31 are pivotally attached to a lower link 33 by pin assembly 17. Lower links 33 are each pivotally attached to an arm 25 by pin 21. Arms 25 are pivotally attached to the outside surfaces of sideplates 12 by a pin 39. A hole in arms 25 receives a pin (shown as 81 in FIG. 3), connecting operating mechanism 10 to a contact arm (not shown) in each of the rotary contact assemblies (shown 80 in FIG. 3). A pair of tension springs 26 extend between a pin 35 disposed on handle yoke 22 and pin assembly 17 to bias cradle assembly 18 in a clockwise direction (as shown in FIG. 1) about pin 20.

Cradle assembly 18 comprises a pair of cradle plates 28 fixedly spaced apart in a substantially parallel relationship. A latching shoulder 30 is formed on corresponding edges of each cradle plate 28. Latching shoulder 30 is accommodates a latching tab 32, which is described in detail below. Camming surfaces 36, which are generally arcuate outer edges of cradle plates 28, are positioned adjacent to latching shoulders 30 on each cradle plate 28. Each cradle plate 28 further contains an arm 38 that is adjacent to camming surfaces 36 and depends therefrom. The end of each arm 38 terminates in a cradle stop surface 40.

Latching mechanism 14 includes a primary latch 34, which is pivotally mounted on a latch pin 42 supported between sideplates 12. Primary latch 34 is a substantially H-shaped structure having two elongated leg members 44 connected to each end of a cross bar 46. Latching tabs 32, which are generally flat planar members protruding from cross bar 46, engage latching shoulders 30 on cradle plates 28 when circuit breaker operating mechanism 10 is moved from a tripped position to a reset position, thereby retaining cradle assembly 18 in a latched position. Primary latch 34 further includes a notched area 48 formed into an upper part of each elongated leg member 44.

Primary latch 34 is designed to flex under the load generated by cradle assembly 18 to account for non-uniformities in the loading. Cross bar 46 is flexible along a longitudinal axis thereof, thereby allowing cross bar 46 to be deflected at any point along its length and allowing cross bar 46 to be axially twisted. This flexibility allows each elongated leg member 44 to engage a corresponding latching surface 68 on a secondary latch 54 independently of the other elongated leg member 44. The overall deflectability and twistability of cross bar 46 enables each elongated leg member 44 to be accurately positioned to independently engage secondary latch 54 to provide sufficient stability to circuit breaker operating mechanism 10 while allowing for slight variations in the manufacture of the system components. Because manufacturing tolerances are increased, the overall manufacturing costs for the operating mechanism 10 is less expensive.

Latching mechanism 14 also includes secondary latch, shown generally at 54, which is also pivotally mounted between sideplates 12. Secondary latch 54 is a substantially U-shaped structure having pins 56 integrally formed into tabs 58 projecting therefrom and is mounted between sideplates 12 by engaging pins 56 with slots 60 in sideplates 12. Although secondary latch 54 is mounted between sideplates 12, elongated leg members 62 of secondary latch 54 depending from a base member 64 are positioned over the outsides of sideplates 12, thereby causing secondary latch 54 to straddle circuit breaker operating mechanism 10. Elongated leg members 62 have disposed on the ends thereof feet 63, which extend perpendicularly away from elongated leg members 62. Latching surfaces 68 are positioned on base member 64 proximate the points where elongated leg members 62 meet base member 64 and are configured to be engageable with notched areas 48 on primary latch 34. Secondary latch 54 is biased toward primary latch 34 by a secondary latch return spring 90 (clockwise about pin 56 as shown with reference to FIG. 1), which extends from a pin 92 positioned between sideplates 12 to an aperture 94 in base member 64 of secondary latch 54.

Figure 2:
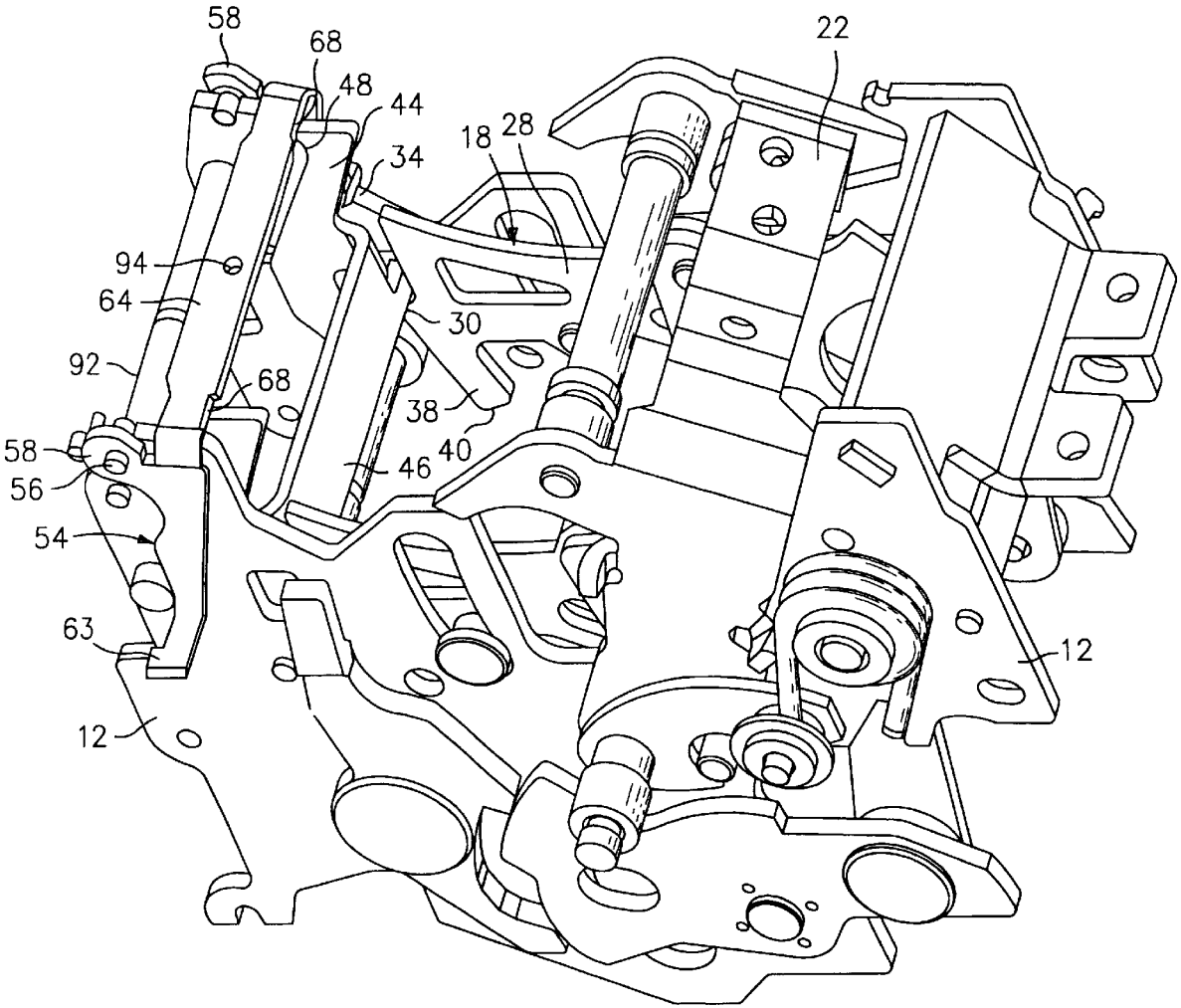
FIG. 2 is a perspective view of a circuit breaker operating mechanism showing a primary latch and a secondary latch engaged with each other.

Referring to FIG. 2, primary latch 34 and secondary latch 54 are shown in a latched position. The loading of cradle assembly 18 by tension springs 26 (FIG. 1) causes primary latch 34 to rotate about its pivot point and engage secondary latch 54. Latching of the mechanism occurs when notched areas 48 on primary latch 34 simultaneously engage latching surfaces 68 on secondary latch 54. Simultaneous engagement of notched areas 48 with latching surfaces 68 is virtually ensured by the uniform loading of cradle assembly 18 across the width of primary latch 34, which is generally defined by the length of cross bar 46. However, in the event of non-uniform loading of cradle assembly 18, notched areas 48 on one elongated leg member 44 of primary latch 34 and the corresponding latching surface 68 on secondary latch 54 may be predisposed to engagement while another notched area 48 on another elongated leg member 44 and its corresponding latching surface 68 on an opposite end of secondary latch 54 may not be predisposed to engagement. In such an instance, the flexibility of cross bar 46 ensures that the independent movement of elongated leg members 44 relative to cross bar 46 will compensate for the non-uniform loading, thereby enabling notched areas 48 on elongated cross members 44 and latching surfaces 68 on secondary latch 54 to engage with each other to latch cradle assembly.

A predisposition for engagement of one notched area 48 on one elongated leg member 44 with latching surface 68 and not of another notched area 48 on another elongated leg member 44 with another latching surface 68 may also occur as a result of inaccurately toleranced components. In such an instance, the flexibility of cross bar 46 accommodates the lack of precision involved in the machining of the parts and allows both notched areas 48 on elongated cross members 44 to engage with their respective latching surfaces 68 on secondary latch 54, thereby allowing primary latch 34 and secondary latch 54 to properly engage each other to latch cradle assembly 18.

Figure 3:
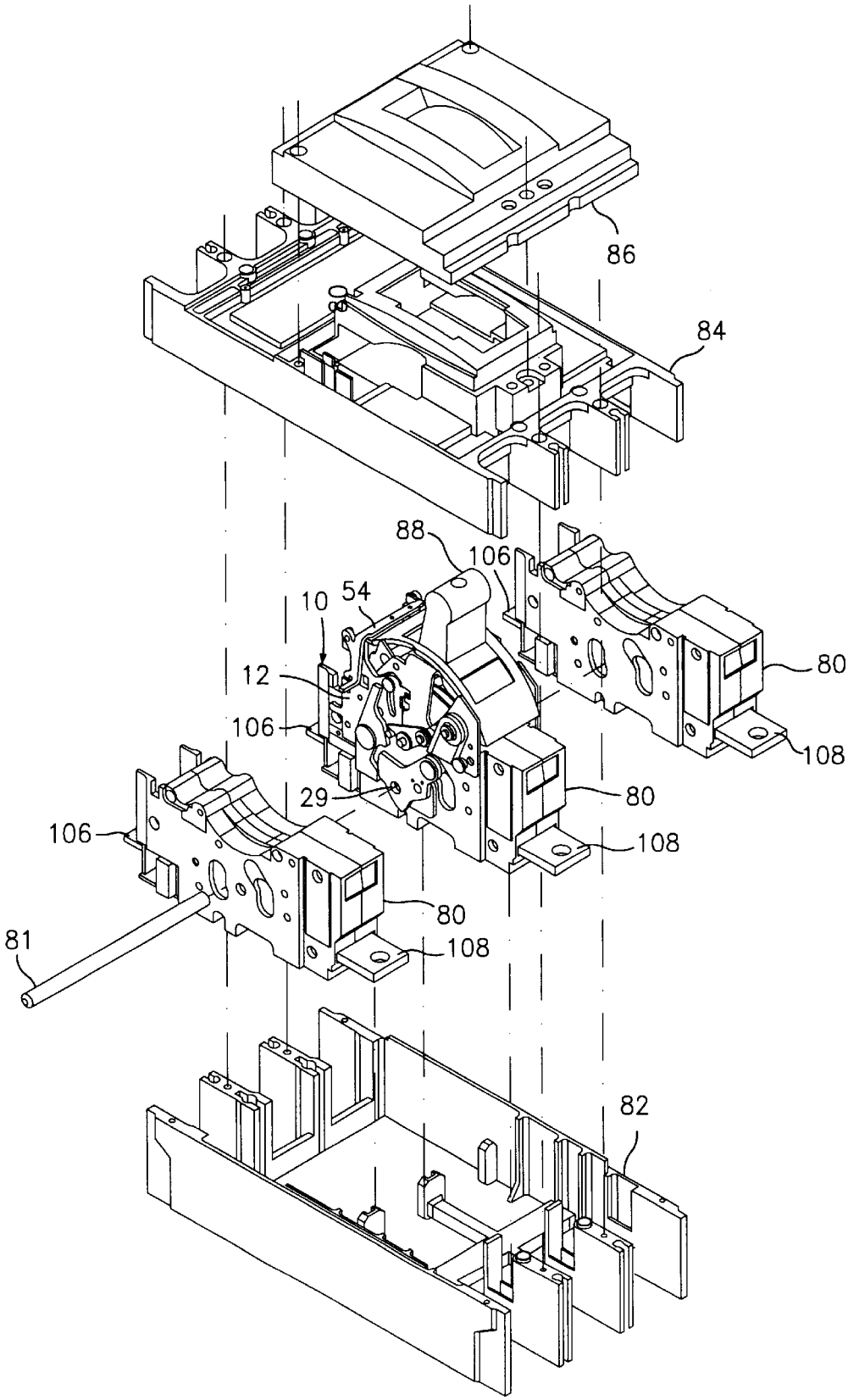
FIG. 3 is an exploded perspective view of rotary contact assemblies and a circuit breaker operating mechanism positioned on a baseplate.

Referring now to FIG. 3, circuit breaker operating mechanism 10 is shown mounted to a rotary contact assembly 80. Additional rotary contact assemblies 80 are also shown being mounted to base plate 82 adjacent circuit breaker operating mechanism 10. A mid-cover 84 is positioned over rotary contact assemblies 80 in base plate 82, and a face plate 86 is positioned over operating handle 88. Secondary latch 54 of latching mechanism 14 straddles sideplates 12 of circuit breaker operating mechanism 10.

Figure 4:
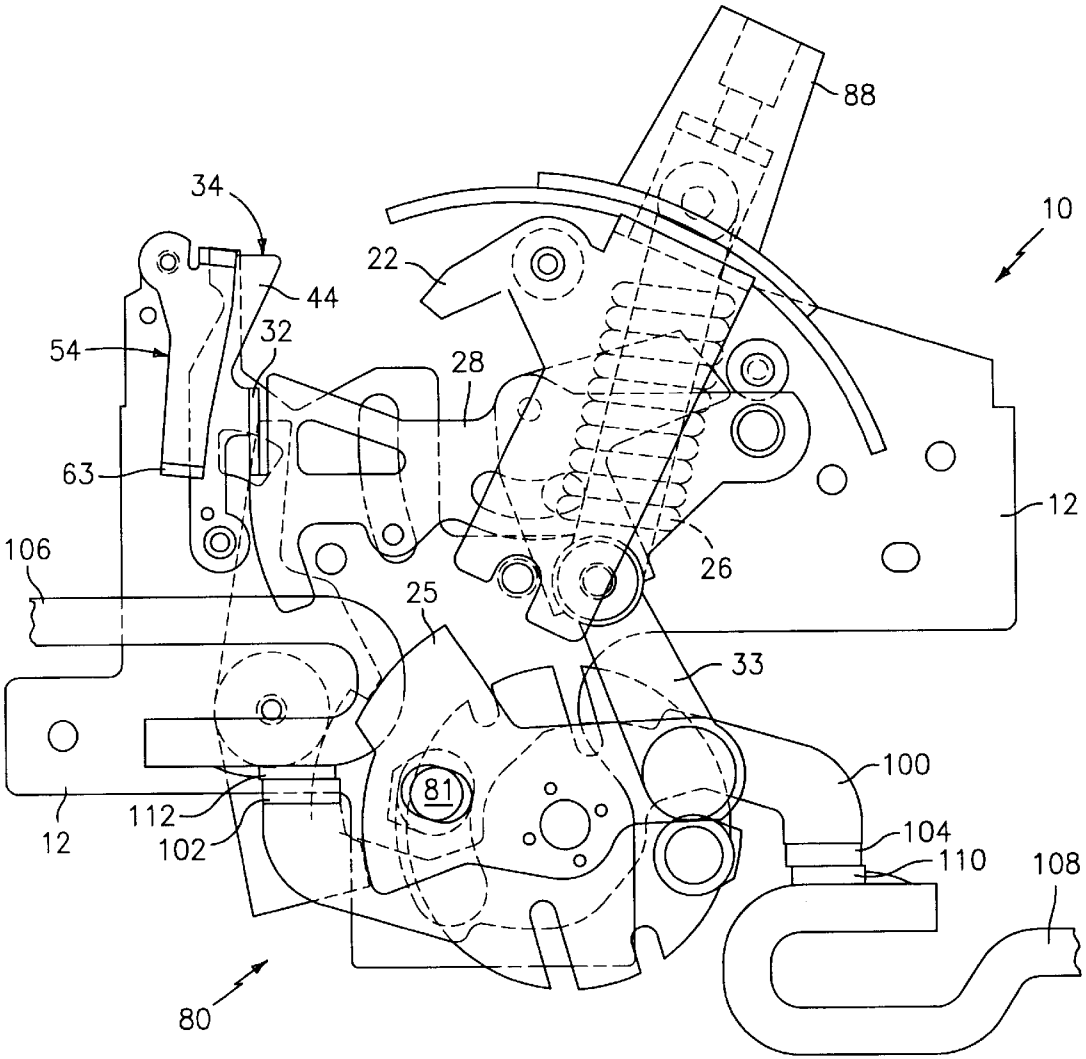
FIG. 4 is a side view of the circuit breaker operating mechanism mounted on a rotary contact assembly.

Referring to FIG. 4, each rotary contact assembly 80 includes a rotary contact arm 100 rotatably mounted therewithin. An electrical contact 102 is secured to one end of the rotary contact arm 100, and an electrical contact 104 is secured to an opposite end to the rotary contact arm 100. Each rotary contact assembly 80 also includes a current carrying strap 106 extending from a load side of the cassette assembly 80 and a current carrying strap 108 extending from a line side of the cassette assembly 80. Electrically connected to the line side current carrying strap 108 is a fixed contact 110 arranged proximate to contact 104. Electrically connected to the load side current carrying strap 106 is a fixed contact 112 arranged proximate to the contact 102. The rotary contact arm 100 rotates to bring the contacts mounted on the rotary contact arm (movable contacts) 102 and 104 into and out of electrical connection with their associated fixed contacts 112 and 110, respectively. When the fixed and movable contacts 102 and 112, and 104 and 110 are touching (closed), electrical current passes from the line side current carrying strap 108 to the load side current carrying strap 106 via the closed contacts. When contacts 102 and 112, and contacts 104 and 110 are separated (opened), the flow of electrical current from the line side current carrying strap 108 to the load side current carrying strap 106 is interrupted.

Referring to FIGS. 1 to 4, in an overcurrent or fault condition, an actuating device (not shown) rotates secondary latch 54 in a counter-clockwise direction (as shown in FIG. 1). Rotation of the secondary latch causes notched areas 48 of primary latch 34 to be released from latching surfaces 68 of secondary latch, which allows primary latch 34 to rotate in a counter-clockwise direction (as shown in FIG. 1) about pin 42. Rotation of primary latch 34 causes latching tabs 32 to release from latching shoulders 30 of cradle plates 28, thus allowing cradle plates 28 to rotate in a clockwise direction (as shown in FIG. 1) about pin 20. The rotation of cradle plates causes toggle links 31 and lower links 33 to move upwards. Such movement of the toggle links 31 and lower links 33 causes the counter-clockwise rotation (as shown in FIG. 1) of arms 25 about pins 39. The counter-clockwise rotation (as shown in FIG. 1) of arms 25 is translated by pin 81 to the rotary contact arms 100 within rotary contact assemblies 80, causing the rotary contact arms 100 to rotate and separate the pairs of fixed and movable contacts 102 and 112, and 104 and 110.

The latching mechanism described herein is self-compensating, allowing the latching mechanism to be stable even when there is non-uniform loading of the operating mechanism (e.g., non-uniform loading of cradle assembly 18). Because the latching mechanism is stable under all loading conditions, there is less likelihood that the latching mechanism will be responsible for spuriously causing the circuit breaker operating mechanism to trip. In addition, because the latching mechanism compensates for non-uniform loading, manufacturing tolerances for the entire operating mechanism can be increased, thereby reducing the manufacturing cost of the operating mechanism.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A latching mechanism for a circuit breaker operating mechanism, said latching mechanism comprising:

a primary latch, said primary latch including a cross bar and a first pair of elongated leg members mounted to said cross bar; and a secondary latch, said first pair of elongated leg members being in removable engagement with said secondary latch;

wherein said cross bar twists about a longitudinal axis thereof.

2. The latching mechanism of claim 1, wherein said cross bar is flexible.

3. The latching mechanism of claim 2, wherein said cross bar deflects at a point along a longitudinal axis of said cross bar.

4. A circuit breaker operating mechanism for rotating a contact arm, the circuit breaker operating mechanism comprising:

a cradle plate operably connected to the contact arm; and a latching mechanism in removable engagement with said cradle plate, said latching mechanism comprising:

a primary latch, said primary latch including a cross bar and a first pair of elongated leg members mounted to said cross bar; and a secondary latch, said first pair of elongated leg members being in removable engagement with said secondary latch;

wherein said cross bar twists about a longitudinal axis thereof.

5. The circuit breaker operating mechanism of claim 4, wherein said cross bar is flexible.

6. The circuit breaker operating mechanism of claim 5, wherein said cross bar deflects at a point along a longitudinal axis of said cross bar.

7. A circuit breaker, comprising:

a first electrical contact;

a second electrical contact arranged proximate to said first electrical contact; and a circuit breaker operating mechanism configured to separate said first and second electrical contacts, said circuit breaker operating mechanism including:

a cradle plate operatively connected to said first electrical contact, and a latching mechanism in removable engagement with said cradle plate, said latching mechanism comprising:

a primary latch, said primary latch including a cross bar and a first pair of elongated leg members mounted to said cross bar, and a secondary latch in removable engagement with said first pair of elongated leg members;

wherein said cross bar twists about a longitudinal axis thereof.

8. The circuit breaker of claim 7, wherein said cross bar is flexible.

9. The circuit breaker of claim 8, wherein said cross bar deflects at a point along a longitudinal axis of said cross bar.

10. The circuit breaker of claim 7, wherein said primary latch further includes:

a latching tab protruding from said cross bar, said latching tab engaging a latching shoulder formed on said cradle plate.

11. A circuit breaker operating mechanism for moving a contact arm, the circuit breaker mechanism comprising:

a first assembly disposed on a first side of the contact arm;

a second assembly disposed on a second side of the contact arm opposite the first side, the second assembly cooperating with the first assembly to move the contact arm;

a secondary latch; and a primary latch including:

a first portion releasably engaged with the first assembly and with the secondary latch, a second portion releasably engaged with the second assembly and with the secondary latch, and a cross bar extending between the first portion and the second portion, the cross bar being resiliently flexible to allow the first portion to move relative to the second portion.

12. The circuit breaker operating mechanism of claim 11, wherein the first portion includes a first leg and the second portion includes a second leg.

13. The circuit breaker operating mechanism of claim 11, wherein the first assembly includes:

a first cradle operably coupled to the contact arm by a linkage, the first cradle being releasably restrained by the first portion; and wherein the second assembly includes:

a second cradle operably coupled to the contact arm by a linkage, the second cradle being releasably restrained by the second portion.

* * * * *